US008022336B2

(12) United States Patent
Casasso et al.

(10) Patent No.: US 8,022,336 B2
(45) Date of Patent: Sep. 20, 2011

(54) METHOD AND AN APPARATUS FOR CONTROLLING GLOW PLUGS IN A DIESEL ENGINE, PARTICULARLY FOR MOTOR-VEHICLES

(75) Inventors: Paolo Casasso, Cueno (IT); Angelo Argento, Turin (IT); Filippo Parisi, Turin (IT); Stefano Nieddu, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 303 days.

(21) Appl. No.: 12/470,322

(22) Filed: May 21, 2009

(65) Prior Publication Data

US 2009/0289048 A1 Nov. 26, 2009

(30) Foreign Application Priority Data

May 21, 2008 (EP) ..... 08009375

(51) Int. Cl.
*F23Q 7/00* (2006.01)
*F02P 19/02* (2006.01)

(52) U.S. Cl. ..... 219/262; 123/179.6

(58) Field of Classification Search ..... 219/262, 219/260, 261, 263, 264, 265, 266, 267, 268, 219/269, 270; 123/179.6, 179.1, 179.2, 179.3, 123/179.4, 179.5
See application file for complete search history.

(56) References Cited

U.S. PATENT DOCUMENTS 4,653,443 A * 3/1987 Fukazawa et al. ..... 123/145 A
6,148,258 A 11/2000 Boisvert et al.
6,712,032 B2 * 3/2004 Uhl et al. ..... 123/145 A
7,658,174 B2 * 2/2010 Stoller ..... 123/145 A
7,825,352 B2 * 11/2010 Last et al. ..... 219/270

FOREIGN PATENT DOCUMENTS

| | | | |
|---|---|---|---|
| DE | 3738055 | A1 | 5/1989 |
| JP | 57002471 | A | 1/1982 |
| JP | 1081665 | A | 3/1989 |
| JP | 5106546 | A | 4/1993 |
| WO | 9408136 | A1 | 4/1994 |
| WO | 2007033825 | A1 | 3/2007 |

* cited by examiner

*Primary Examiner* — Daniel Robinson
(74) *Attorney, Agent, or Firm* — Ingrassia Fisher & Lorenz, P.C.

(57) ABSTRACT

A method is provided for controlling a glow plug (GP) associated with a cylinder chamber of a Diesel engine. The method includes, but is not limited to the steps of driving in an on-off manner in a period of time an electronic switch (M) connected essentially in series with the glow plug (GP) between the terminals of a d.c. voltage supply (B), sensing the voltage (V) across the glow plug (GP) and the current (I) flowing through the glow plug (GP) and performing a voltage closed loop control for controlling the temperature of the glow plug (GP). The method further includes, but is not limited to the steps of calculating a normalized current error ($\epsilon I$) as a function of said sensed current (I), calculating a normalized voltage error ($\epsilon V$) as a function of said sensed voltage (V), calculating a weight function (K) as a function of predetermined parameters ($\alpha$, $\beta$, n) and calculating a global error ($\epsilon$) as a function of said normalized current error ($\epsilon I$), normalized voltage error ($\epsilon V$) and weight function (K). Finally, the method includes, but is not limited to the step of combining the voltage closed loop control with a current closed loop control according to the value of said global error ($\epsilon$).

10 Claims, 3 Drawing Sheets

METHOD AND AN APPARATUS FOR CONTROLLING GLOW PLUGS IN A DIESEL ENGINE, PARTICULARLY FOR MOTOR-VEHICLES

CROSS-REFERENCE TO RELATED APPLICATION

This application claims priority to European Patent Application No. 08009375.0, filed May 21, 2008, which is incorporated herein by reference in its entirety.

TECHNICAL FIELD

The present invention relates to a method and an apparatus for controlling glow plugs in a Diesel engine.

BACKGROUND

Glow plugs are typically associated with the cylinder chambers of Diesel engines, and are controlled by an associated electronic control module which is arranged to control in real time the amount of energy transferred to each glow plug, so as to reach and hold a predetermined working temperature. The glowing control apparatus comprises also electrical connections between a vehicle voltage supply, such as the battery of the vehicle, the glow plugs and the electronic control module. The electronic control module drives the electronic switches, generally MOSFET transistors, by means of pulse-width-modulated (PWM) control signals.

FIG. 1 is an electric diagram showing an apparatus for controlling glow plugs in a Diesel engine. In FIG. 1 reference numeral 10 generally indicates an electronic control system for driving the glow plugs GP1, GP2, GP3 and GP4 associated each with a respective cylinder chamber in a 4-cylinder Diesel internal combustion engine. The glow plugs GP1-GP4 are connected each between a respective output terminal 1-4 of the electronic control system 10 and a ground terminal EGND ("engine ground").

In FIG. 1 a d.c. voltage supply B, such as the battery of the motor-vehicle, has its positive terminal connected to a supply input 5 of the electronic control system 10, and the negative terminal connected to a ground terminal BGND ("battery ground"). The ground terminal BGND is connected to the ground terminal EGND by a conductor 6, and is further connected to a terminal 7 of the electronic control system 10 through a conductor 8. The terminal 7 of the electronic control system is connected to an "internal ground" terminal IGND of the electronic control system 10, through a conductor 9.

The electronic control system 10 comprises four electronic switches M1-M4, having each the drain-source path connected essentially in series with a respective glow plug, between the terminals of the voltage supply B.

The electronic switches M1-M4 are, for instance, MOSFET transistors, and have their gates connected to respective outputs of a control unit 20. The control unit 20 drives said switches M1-M4 in order to realize a PWM control.

The control system 10 has a node A which is used to measure, in a known manner, the voltage across the glow plugs GP1-GP4.

The glowing control system 10 above disclosed has many disadvantages: For example: the electrical resistance of each glow plug GP1-GP4 is low, so any variation in the resistive path between the node A and the terminals 1-4 causes a variation in the voltage drop across the glow plugs, and consequently an imprecise temperature control; the glow plugs GP1-GP4 are mechanically grounded to the engine block: in fact, only the PWM control signals are supplied to the glow plugs GP1-GP4 while the electrical return path is provided by the connection between the "engine ground" terminal EGND and the "battery" terminal BGND, which provides ground return also for systems requiring high currents, like engine starter, generator, etc. . . . These high currents could cause a significant voltage drop across the conductor 6, represented as a voltage drop Vd1 on a resistor R1 of the conductor 6. Furthermore, another voltage drop Vd2 on a resistor R2 representing the resistance of the conductor 8 affects the connection between the "battery" terminal BGND and the "internal ground" terminal IGND. This means that the voltage supplied to energize the glow plugs GP1-GP4 is affected by an error due to the ground shift between the "engine ground" terminal EGND and the "internal ground" terminal IGND of the electronic control system 10, so resulting in an imprecise temperature control. These series voltage drops depend on the engine electrical architecture and the values change with the engine conditions.

The energy transferred to the glow plugs GP1-GP4 is the key variable to be controlled, and conventional glow-plug control systems generally monitor both the voltage across each glow plug and the current flowing through each glow plug. Controlling the energy transferred to the glow plugs GP1-GP4 means controlling the power transferred thereto during each period of the PWM driving signals applied to the corresponding electronic switches M1-M4. The duty-cycle of the PWM driving signals is controlled in a closed-loop, in order to supply the desired energy to each glow plug GP1-GP4.

In a first control method (voltage control) the control unit 20 defines a voltage duty factor that must be applied to each glow plug GP1-GP4. The control unit 20 performs a voltage closed loop control by monitoring the supply voltage B at the node A. The voltage duty factor is a function of said monitored voltage.

The PWM signals generated by the control unit 20 depend on the difference between the voltage at the node A and the potential at the "internal ground" terminal IGND, whereas the heating power generated in each glow plug GP1-GP4 is a function of the voltage at the node A and the potential present at the "engine ground" terminal EGND of the glow plugs GP1-GP4.

In a second control method (current control), the control unit 20 defines a current duty factor for each glow plug GP1-GP4. The control unit 20 performs a current closed loop control by monitoring the current flowing through the glow plugs GP1-GP4. The current duty factor is a function of said monitored current.

The main idea of the present invention is to identify a state variable which is not influenced by the resistive path and ground shifts between the control unit 20 and glow plugs GP1-GP4. Even if the current control method has brought good results for certain heating points, it shows low accuracies of the controlled temperature, mainly due to the electrothermal characteristics of the components.

Furthermore, another side effect present in the control system 10 above disclosed is due to tolerances of the glow plugs: glow plug resistance can have a not negligible spread which affects the temperature.

The known voltage control minimizes the resistance spread effect on the temperature regulation, but the performances result heavily affected by the series voltage drops. The known current control rejects the series voltage drops, but the temperature regulation results heavily affected by the resistance spread effect.

It is at least one object of the present invention to provide an improved method and an improved apparatus for controlling glow plugs in a Diesel engine that includes the advantages of both a voltage loop control and a current loop control, allowing to overcome the above-outlined inconveniences of the prior art systems. In addition, other objects, desirable features, and characteristics will become apparent from the subsequent summary and detailed description, and the appended claims, taken in conjunction with the accompanying drawings and this background.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background and summary or the following detailed description.

Figure 1:
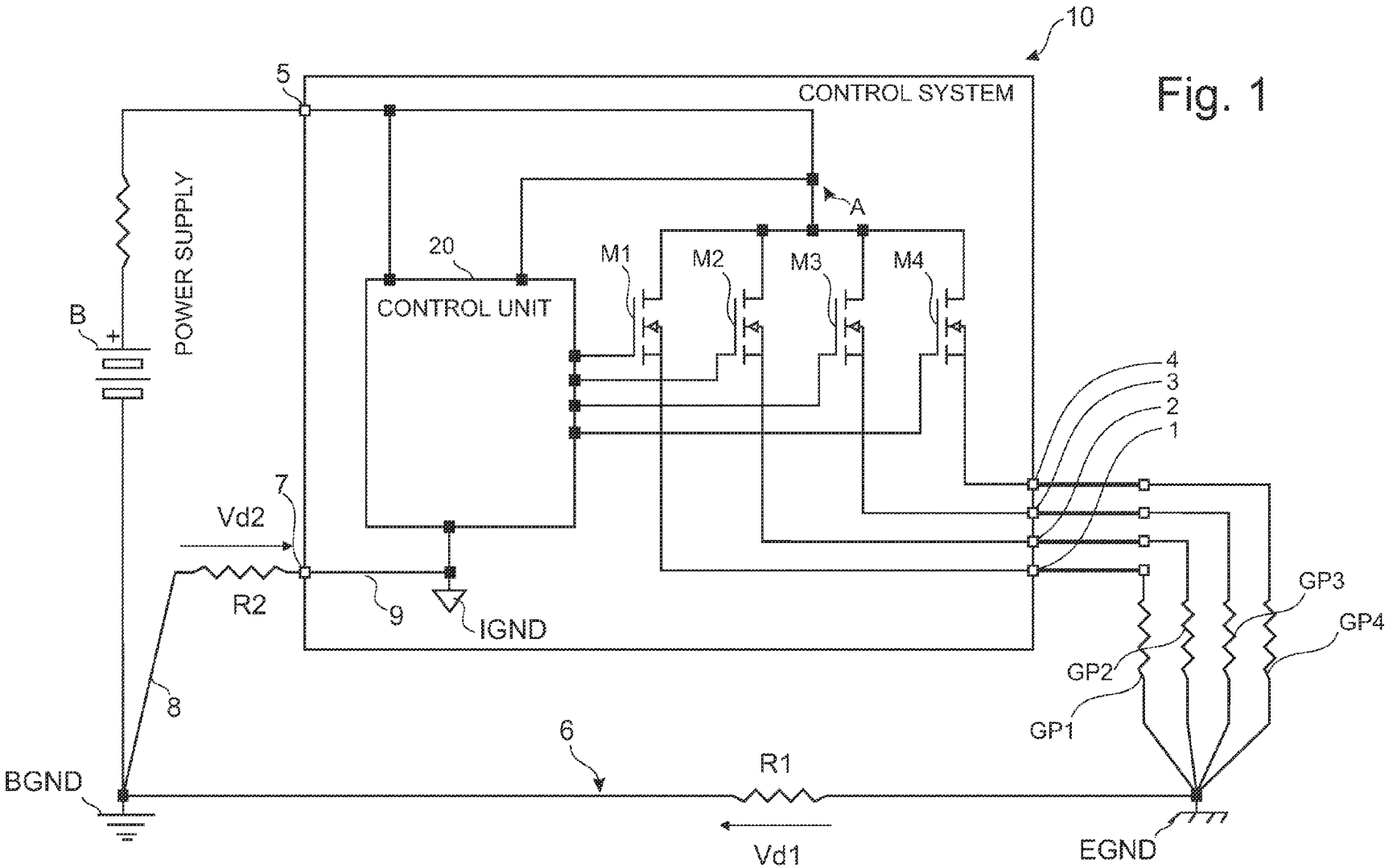
FIG. 1, which has already been described, is an electric diagram showing an apparatus for controlling glow plugs in a Diesel engine of the prior art.
Figure 2:
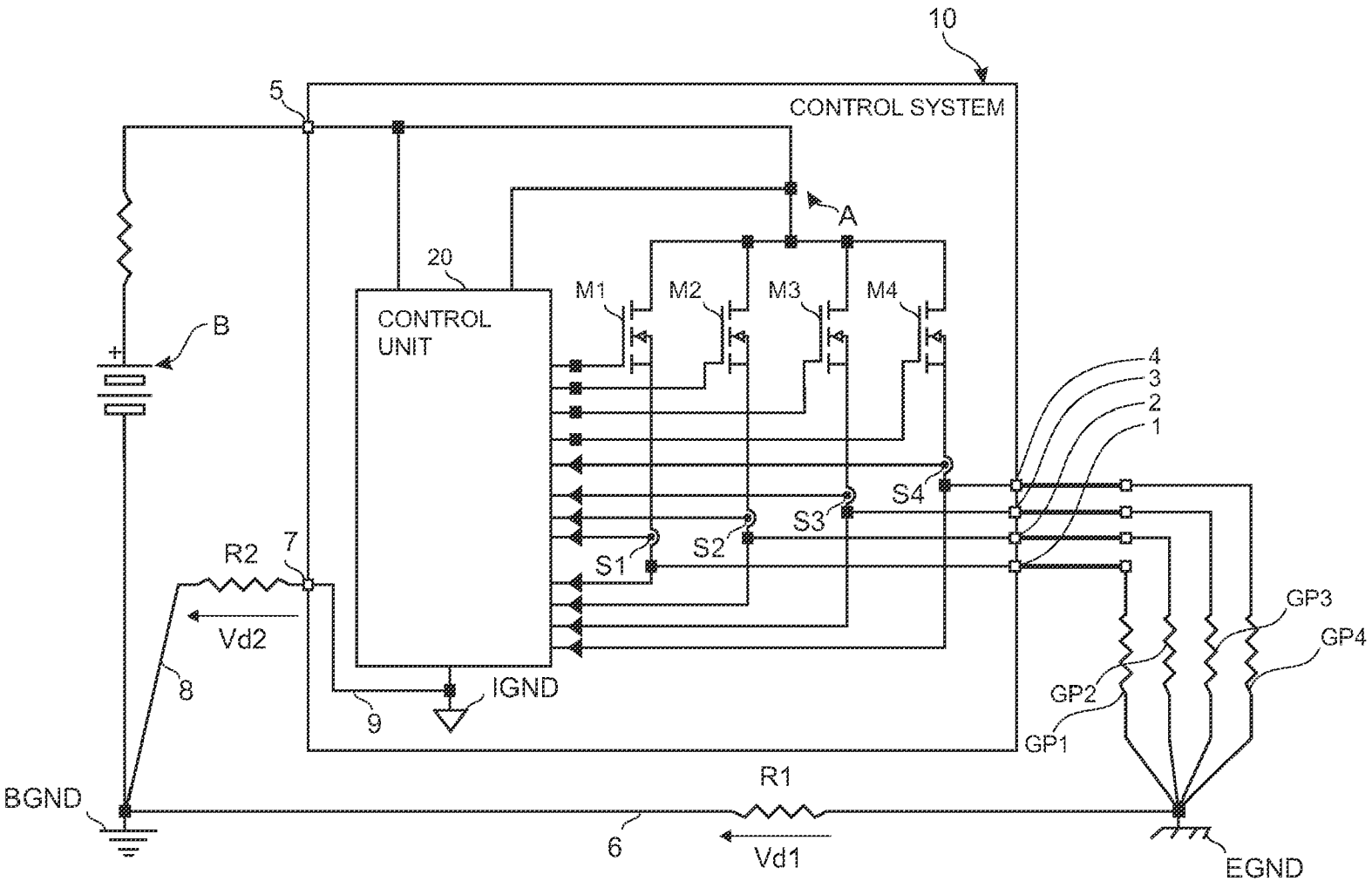
FIG. 2 is an electric diagram showing an apparatus for controlling glow plugs in a Diesel engine according to an embodiment of the invention.

FIG. 2 is an electric diagram showing an apparatus for controlling glow plugs in a Diesel engine according to an embodiment of the invention. Similar elements to those shown in FIG. 1 have the same reference numeral.

The unit 20 has a first series of four inputs which are connected each to a respective one of the terminals 1-4, to provide said unit with an analogue signal representative of the voltage across the corresponding glow plugs GP1-GP4. Alternatively, it is possible to use the voltage measured at node A.

The unit 20 has a second series of four inputs, which are connected each to a respective current-sensing means S1-S4, such as a shunt resistor, to provide said unit 20 with signals representative of the current flowing in the operation through each of the glow plugs GP1-GP4.

In the arrangement shown in FIG. 2, the current-sensing means S1-S4 are arranged between the electronic switches M1-M4 and the glow plugs GP1-GP4. In an essentially equivalent arrangement, the sensors could be arranged between the electronic switches M1-M4 and the positive terminal of the voltage supply B.

Since the glow plugs GP1-GP4 are pure resistive loads having a nominal resistance, a series voltage drop will result in a variation of the current flowing through the glow plugs GP1-GP4. It is therefore possible to determine the voltage drop by monitoring the glow plug current, using a normalized current error $\epsilon I$ defined as follows:

$$\varepsilon_I = \frac{I^* - \tilde{I}}{I^*} \tag{1}$$

where I* is a current setpoint calculated as a voltage setpoint V*, such as the battery voltage, divided by the nominal glow plug resistance and $\tilde{I}$ is the current measured by the current-sensing means S1-S4.

The difference between the current setpoint I* and the measured current $\tilde{I}$ (i.e., the current deviation), is used in the following function:

$$K = \frac{1}{\beta + (\alpha\varepsilon_I)^n} \quad n = 2, 4, 6, \ldots \tag{2}$$

where α, β and n are variable values.

Figure 3:
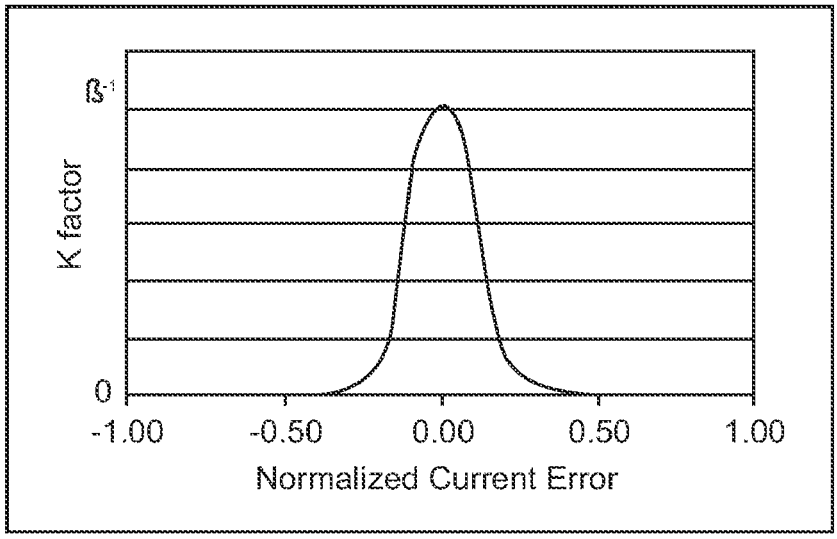
FIG. 3 shows the general shape of a function utilized in an embodiment of the invention.

The K-function provides a value within the range [0,β−1] that estimates the voltage drop across the glow plugs GP1-GP4. In particular, if the voltage drop increases, K will tend to 0, otherwise, when this side effect becomes negligible, K will tend to β−1. In FIG. 3 the general shape of the K-function is illustrated.

The K-function is used to change the control from the voltage control to the current control, depending on the estimated voltage drop. This is obtained by calculating a global error $\epsilon$ as a weight sum of current and voltage normalized errors, where the weight factor is provided by the function K, according to the following equation:

$$\epsilon = \epsilon_I(1-K) + \epsilon_V K \tag{3}$$

where the normalized voltage error $\epsilon V$ is defined as follows:

$$\varepsilon_V = \frac{U^* - \tilde{U}}{U^*} \tag{4}$$

where U* is a voltage setpoint, such as the battery voltage, and $\tilde{U}$ is the measured voltage.

Looking at the global error $\epsilon$ expression it is simple to understand that the control will tend to a current loop control when the weight factor K tends to zero, while it will tend to a voltage control loop when the weight factor K increases (hybrid control).

A Monte-Carlo analysis has been performed, taking into account glow plug electro-mechanical dispersions and the current and voltage normalized errors at different ground shift values. The analysis has been performed for the following different control strategies: voltage close loop control; current closed loop control; and hybrid closed loop control.

The resulting steady-state glow plug temperature distributions have been compared in order to evaluate the hybrid control robustness to ground shifts. Particularly, the results have been statistically interpreted in terms of Defects Per Unit (DPU), with reference to a range of temperature comprised between about 920° C. and about 1080° C.

Figure 4:
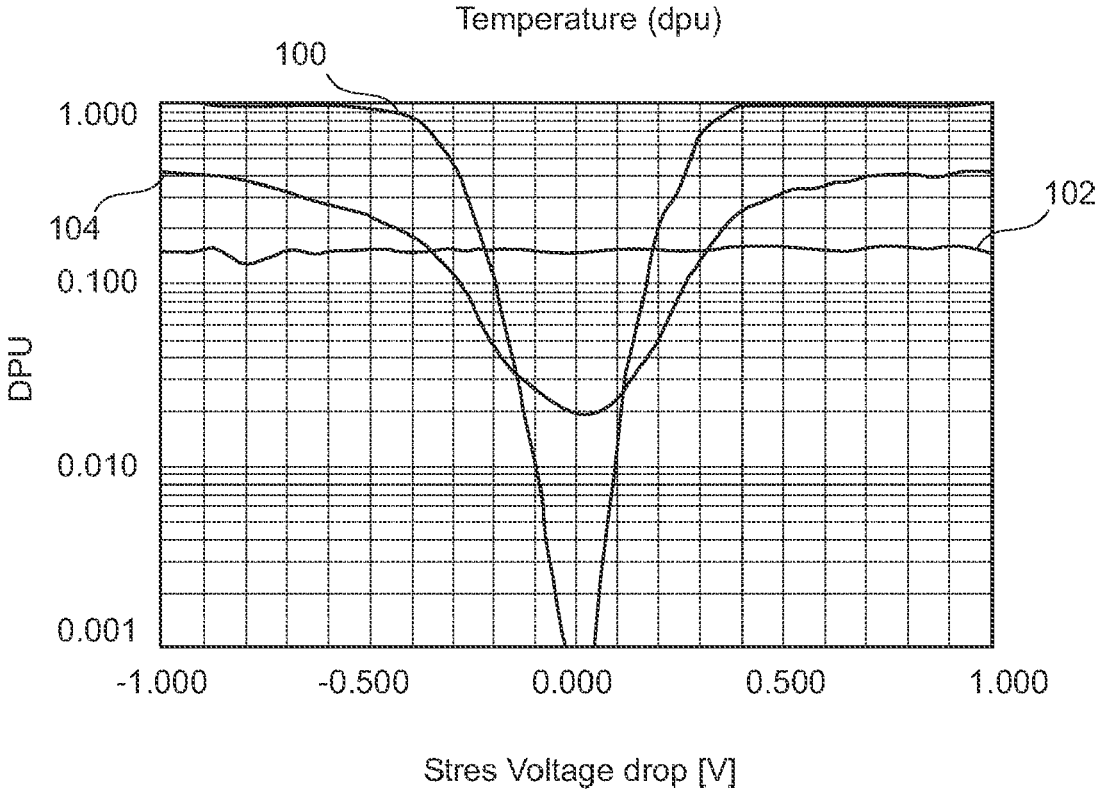
FIG. 4 is a graph of a parameter (DPU) vs. the voltage drop relating to the temperature of a glow plug.

FIG. 4 shows a graph of the DPU vs. the voltage drop. A first curve 100 is related to the voltage control, a second curve 102 is related to the current control and a third curve 104 is related to the hybrid control.

It can be noted that for low voltage drop values the hybrid control is very similar to the voltage control, thus keeping all its advantages in term of robustness to component tolerances. It can be also seen that for low voltage drop values the current control is less robust because of its dependences from the component electrical resistance tolerances.

Furthermore, when the voltage drop increases the hybrid control results to be better than the voltage control (lower value of DPU) because the influence of the current loop increases, thus giving to the control a higher robustness to the voltage drops.

The embodiments of the invention are applicable to Diesel engines with three, four, six and eight cylinders.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method for controlling a glow plug (GP) associated with a cylinder chamber of a Diesel engine, comprising the steps of:

driving in an on-off manner in a period of time, an electronic switch (M) connected essentially in series with the glow plug (GP) between terminals of a d.c. voltage supply (B);

sensing a voltage (V) across the glow plug (GP) and a current (I) flowing through the glow plug (GP); and performing a voltage closed loop control for controlling a temperature of the glow plug (GP);

calculating a normalized current error (ϵI) as a function of the current (I);

calculating a normalized voltage error (ϵV) as a function of the voltage (V);

calculating a weight function (K) as a function of predetermined parameters (α, β, n);

calculating a global error (ϵ) as a function of said normalized current error (ϵI), the normalized voltage error (ϵV) and the weight function (K); and combining the voltage closed loop control with a current closed loop control according to a value of said global error (ϵ).

2. The method of claim 1, wherein said normalized current error (ϵI) is calculated according to the following equation:

$$\varepsilon_I = \frac{I^* - \tilde{I}}{I^*}$$

where I* is a predetermined current setpoint and Ĩ is the current.

3. The method of claim 1, wherein the normalized voltage error (ϵV) is calculated according to the following equation:

$$\varepsilon_V = \frac{U^* - \tilde{U}}{U^*}$$

where U* is a predetermined voltage setpoint and Ũ is the voltage.

4. The method of claim 1, wherein the weight function (K) is calculated according to the following equation:

$$K = \frac{1}{\beta + (\alpha\varepsilon_I)^n}.$$

5. The method of claim 1, wherein the global error (ϵ) is calculated according to the following equation:

$$\epsilon = \epsilon_I(1-K) + {}_V K.$$

6. An apparatus for controlling a glow plug (GP) associated with a cylinder chamber of a Diesel engine, comprising:

an electronic switch (M) connected essentially in series with the glow plug (GP) between terminals of a d.c. voltage supply (B);

a sensor (S) adapted to provide a signal representative of a current flowing through the glow plug (GP) and the voltage across the glow plug (GP); and an electronic controller coupled to a control input of the electronic switch (M) and to the sensor (S); the electronic controller adapted to:

drive, in an on-off manner, the electronic switch (M); and perform a voltage closed loop control for controlling a temperature of the glow plug (GP);

calculate a normalized current error (ϵI) as a function of the current (I);

calculate a normalized voltage error (ϵV) as a function of the voltage (V);

calculate a weight function (K) as a function of predetermined parameters (α, β, n);

calculate a global error (ϵ) as a function of said normalized current error (ϵI), the normalized voltage error (ϵV) and the weight function (K); and combine the voltage closed loop control with a current closed loop control according to a value of said global error (ϵ).

7. The apparatus of claim 6, wherein the electronic controller is predisposed for calculating the normalized current error (ϵI) according to the following equation:

$$\varepsilon_I = \frac{I^* - \tilde{I}}{I^*}$$

where I* is a predetermined current setpoint and Ĩ is the current.

8. The apparatus of claim 6, wherein the electronic controller is predisposed for calculating the normalized voltage error (ϵV) according to the following equation:

$$\varepsilon_V = \frac{U^* - \tilde{U}}{U^*}$$

where U* is a predetermined voltage setpoint and Ũ is the voltage.

9. The apparatus of claim 6, wherein the electronic controller is predisposed for calculating the weight function (K) according to the following equation:

$$K = \frac{1}{\beta + (\alpha\varepsilon_I)^n}.$$

10. The apparatus of claim 6, wherein the electronic controller is predisposed for calculating the global error (ϵ) according to the following equation:

$$\epsilon = \epsilon_I(1-K) + \epsilon_V K.$$

* * * * *